US006200435B1

(12) United States Patent
Katayama

(10) Patent No.: US 6,200,435 B1
(45) Date of Patent: Mar. 13, 2001

(54) ION EXCHANGE MEMBRANE ELECTROLYZER

(75) Inventor: Shinji Katayama, Tamano (JP)

(73) Assignees: Chlorine Engineers Corp., Ltd., Tokyo; Tosoh Corporation, Yamaguchi, both of (JP)

( * ) Notice: Subject to any disclaimer, the term of this patent is extended or adjusted under 35 U.S.C. 154(b) by 0 days.

(21) Appl. No.: 09/306,762

(22) Filed: May 7, 1999

(30) Foreign Application Priority Data

May 11, 1998 (JP) ..... 10-127566

(51) Int. Cl.[7] ..... C25B 15/00

(52) U.S. Cl. ..... 204/237; 204/257; 204/258; 204/269; 204/270; 204/280

(58) Field of Search ..... 204/242, 253, 204/267, 237, 269, 270, 283, 288, 289, 257, 258, 280

(56) References Cited

U.S. PATENT DOCUMENTS 4,767,519 * 8/1988 de Nora ..... 204/255
5,130,008 * 7/1992 Cabaraux et al. ..... 204/283
5,314,591 * 5/1994 Katayama et al. ..... 204/257

FOREIGN PATENT DOCUMENTS 0 521 386 1/1993 (EP) .
0 599 363 6/1994 (EP) .
WO 98/55670 12/1998 (WO) .

* cited by examiner

*Primary Examiner*—Kathryn Gorgos
*Assistant Examiner*—Wesley A. Nicolas
(74) *Attorney, Agent, or Firm*—Armstrong, Westerman, Hattori, McLeland & Naughton

(57) ABSTRACT

The present invention provides an electrolyzer, which comprises vertical type electrolyzer units with irregular surfaces formed on partition walls on anode side and on partition walls on cathode side, said irregular surfaces being overlapped on each other and integrated, and electrode plates being connected to convex portions of the partition walls, whereby said irregular surfaces are formed as troughs and ridges extending in vertical direction of the electrolyzer units, said irregular surfaces are divided into a plurality of sectors in height direction, said trough in each sector extends along the same straight line as the ridge of another sector, a liquid junction is provided to connect adjacent troughs in the same sector in the connecting portion of the adjacent sector and to connect the troughs in adjacent sectors, and an internal circulation member is provided between the partition wall and the electrode surface, using inclined surfaces of the trough on the partition wall or a member parallel to the inclined surface of the trough of the partition wall as dividing walls, thereby forming an internal circulation passage where the electrolytic solution flows down.

2 Claims, 5 Drawing Sheets

ION EXCHANGE MEMBRANE ELECTROLYZER

BACKGROUND OF THE INVENTION

The present invention relates to a filter press type electrolyzer, and in particular, to an electrolyzer characterized by circulation of electrolytic solution.

The electrolyzer of filter press type is widely used in various applications such as manufacture of chlorine and caustic soda by electrolysis of salt, or electrolytic manufacture of organic substances, electrolysis of seawater, etc.

In a typical electrolysis method using the filter press type electrolyzer for electrolysis of salt, a bipolar type filter press type electrolyzer is used, in which a plurality of electrolyzer units are placed one upon another via cation exchange membrane, and anode chamber and cathode chamber adjacent to each other are connected electrically and mechanically via partition walls in the electrolyzer units. On both ends, end type electrode chamber units each having anode or cathode on each side thereof are placed on each other, and these are fixed by hydraulic press or other means.

On the other hand, in this bipolar type electrolyzer unit, partition walls are provided to separate the anode chamber from cathode chamber and also to transmit electric current for electrolysis. On the partition wall to separate anode chamber from cathode chamber, anode and cathode are mounted respectively. Depending upon each individual electrolysis reaction, one of the anode chamber and the cathode chamber is in acidic environment, while the other is in reducing environment. In particular, in the electrolysis of salt, i.e. typical electrolysis method utilizing ion exchange membrane, chlorine is generated at anode, and high concentration sodium hydroxide and hydrogen are generated at cathode. In this respect, thin film forming metal such as titanium, tantalum, zirconium, etc. with high corrosion-resistant property, resistant to chlorine, or alloy of these metals are used in the anode chamber. In the atmosphere of the cathode chamber, titanium absorbs hydrogen and is embrittled, and even highly corrosion resistant titanium cannot be used for the cathode chamber. For this reason, ferrous metal such as nickel, stainless steel, etc. or alloy of these metals are used for the cathode chamber. By forming each of these electrode chambers by partition walls made of metal materials and by connecting these chambers together, electrical connection can be achieved. However, if it is tried to connect titanium on the anode chamber side directly with iron, nickel, stainless steel, etc. on the cathode side by welding, intermetallic compound is formed by titanium and ferrous metal on the anode chamber side, and it is not possible to obtain a bonded system, which has sufficient strength suitable for practical application.

To solve these problems, the present applicant filed JP-A-03249189, disclosing a bipolar electrolyzer, which comprises partition walls with irregular surfaces engaged with each other and produced by press procedure, and a structure of electrolyzer units with electrode connected on a convex portion and a method to manufacture the electrolyzer units. Further, the present applicant proposed an electrolyzer with improvement in circulation of electrolytic solution within the bipolar electrolyzer in JP 5005195A (U.S. Pat. No. 5,314,591), JP 5005196A (U.S. Pat. No. 5,314,591), or JP 5009774A (U.S. Pat. No. 5,314,591), etc.

In particular, by the method proposed in JP 5009774A (U.S. Pat. No. 5,314,591), it is possible to achieve better electrical connection through the irregular surfaces on the partition walls. By improving circulation of electrolytic solution in the electrolyzer, even distribution of concentration of the electrolytic solution can be attained, and efficient operation of electrolyzer can be realized.

In the electrolyzers of this type, a system for circulation of electrolytic solution in the electrolyzer is adopted with the purpose of supplying electrolytic solution evenly over the extensive electrode area.

FIG. 6 is a drawing to explain a method to circulate the electrolytic solution by external circulation of electrolytic solution.

From an electrolytic solution inlet 18 on the lower portion of an electrolyzer unit 1, electrolytic solution 31 is introduced into an electrode chamber 4, and the electrolytic solution containing electrolysis products is discharged from a discharge port 32 on the upper portion of the electrolyzer and this is collected in a circulation tank 33. In the circulation tank 33, gas products 34 are separated, and a part of the discharged electrolytic solution is sent to an electrolytic solution preparation process 35, and at least a part of the electrolytic solution in the circulation tank 33 is mixed with a supplementary or make-up solution 36, and this is supplied through the electrolytic solution inlet 18 on the lower portion of the electrolyzer into the electrolyzer using a circulation pump 37, and the solution is circulated.

In case the electrolytic solution is brine or salt water, brine with concentration of 200 g/l is mixed with saturated brine with concentration of 300 g/l at volume ratio of 1:1, and if it is supplied as brine with concentration of 250 g/l, difference in the concentration of the electrolytic solution between the electrolytic solution inlet 18 and the discharge port 32 is 50 g/l.

In order to reduce the concentration difference of the electrolytic solution between the inlet and the discharge port, there is a method to increase the circulation volume of the electrolytic solution and to circulate a larger quantity of electrolytic solution. However, when flow rate is increased, pressure fluctuation in the upper portion of the electrode chamber is increased, and ion exchange membrane dividing anode chamber from cathode chamber is vibrated, and this leads to deterioration of the ion exchange membrane.

Further, FIG. 7 is a schematical drawing to explain a method to circulate electrolytic solution, utilizing the difference in specific gravity of the electrolytic solution caused by electrolysis.

An electrolytic solution tank 38 is provided, which is connected to a discharge port 32 of the electrolyzer in the upper portion of an electrolyzer unit 1, and a pipe on the lower portion of the electrolytic solution tank is connected to an electrolytic solution inlet 18. Electrolysis products containing gases generated in the electrolyzer are moved upward in the electrolyzer because of the difference in specific gravity and reach the electrolytic solution tank 38. In the electrolytic solution tank 38, gas products 34 are separated, and a part of the electrolytic solution is sent to electrolytic solution preparation process 35, and a supplementary solution 36 is added to a part of the electrolytic solution to adjust concentration of the electrolytic solution, and this solution is supplied from the electrolytic solution inlet 18 into the electrode chamber 4.

When the electrolytic solution is supplied to the lower portion of the electrolyzer equipped with an electrolytic solution circulation system as described above, the electrolytic solution is diluted. The concentration of the electrolytic solution at a position away from the electrolytic solution inlet cannot be evenly distributed. Thus, distribution of electric current becomes uneven near the electrolytic solution inlet of the electrode chamber, and this adversely affects voltage for electrolysis.

In case brine is electrolyzed, hydrochloric acid is often added to the brine in order to reduce pH value of the electrolytic solution. Because of uneven distribution of concentration in the electrolytic solution, lower pH occurs near the electrolytic solution inlet, and this often leads to deterioration of ion exchange membrane.

It is an object of the present invention to prevent uneven distribution of concentration and temperature in the electrolytic solution in electrode chambers, to improve voltage and current efficiency and to provide longer service life of ion exchange membrane. In particular, the invention provides an electrolyzer, by which sufficiently high electrolysis performance can be attained in a large size electrolyzer with larger electrode area.

SUMMARY OF THE INVENTION

The present invention provides an electrolyzer, which comprises vertical type electrolyzer units with irregular surfaces formed on partition walls on anode side and on partition walls on cathode side, the irregular surfaces being overlapped on each other and integrated, and electrode plates being connected to convex portions of the partition walls, whereby the irregular surfaces are formed as troughs and ridges extending in vertical direction of the electrolyzer units, the irregular surfaces are divided into a plurality of sectors in height direction, the trough in each sector extends along the same straight line as the ridge of another sector, a liquid junction is provided to connect adjacent troughs in the same sector in the connecting portion of the adjacent sector and to connect the troughs in adjacent sectors, and an internal circulation member is provided between the partition wall and the electrode surface, using inclined surfaces of the trough on the partition wall or a member parallel to the inclined surface of the trough of the partition wall as dividing walls, thereby forming an internal circulation passage where the electrolytic solution flows down.

Also, the present invention provides an electrolyzer as described above, wherein the internal circulation member is formed by a member of triangle pole type having a surface in contact with an inclined surface of the trough in each sector.

Further, the present invention provides an electrolyzer as described above, wherein the internal circulation passage is formed by an inclined surface of a trough in each sector and an internal circulation member, one lateral end of the internal circulation member extending in longitudinal direction of the electrode chamber is in contact with a ridge on the partition wall, and a lateral portion in contact with the partition wall, extending in the direction of the partition wall, and defining the trough and the liquid junction is provided on a lateral end of the longitudinal member opposite to the portion in contact with the ridge of the partition wall.

The present invention provides an electrolyzer as described above, wherein the internal circulation passage is formed by an inclined surface of a trough in each sector and by an internal circulation member, the internal circulation member comprises a longitudinal member extending in longitudinal direction of the electrode chamber, and a lateral member extending from a lateral end of the longitudinal member and defining the trough and the liquid junction, and in a sector adjacent to a sector where the entire surface of the trough is covered with the longitudinal member, the central portion of the longitudinal member is positioned on a ridge of the partition wall in a second sector adjacent to a first sector, and there are provided two lateral portions extending from the lateral end of the longitudinal member toward the partition wall and in contact with the partition wall.

DETAILED DESCRIPTION OF THE PREFERRED EMBODIMENTS

In the following, description will be given on the electrolyzer of the present invention referring to the attached drawings.

Figure 1:
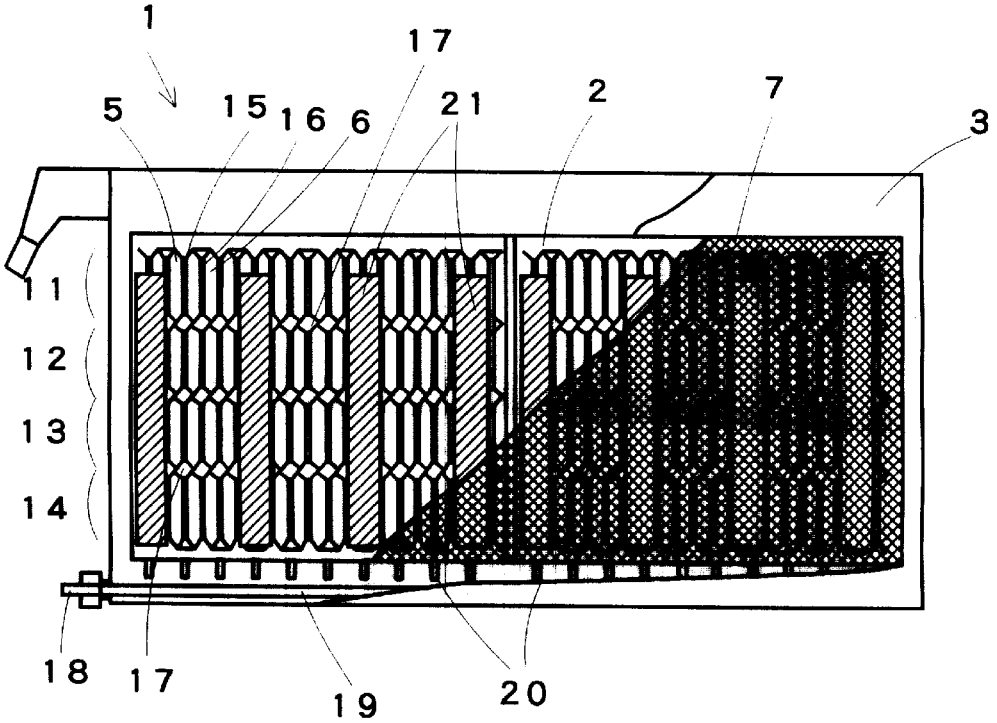
FIG. 1 is a drawing to explain an electrolyzer unit with internal circulation members mounted on partition wall plates in an electrolyzer according to the present invention.

FIG. 1 is a drawing to show an embodiment of a unit electrolyzer of an electrolyzer of the present invention. It is a partially cutaway view seen from anode side, showing a part of electrodes and electrode chamber frame.

As a partition wall 2 on anode side of an electrolyzer unit 1, thin plate made of a material selected from thin film forming metal such as titanium, zirconium, tantalum, etc. or alloy of these metals is molded in form of a pan, and this is engaged with a partition wall (not shown) on cathode side produced by the same molding procedure, and these are mounted on an electrolyzer frame 3. On both partition walls in an electrode chamber 4, concave and convex portions engaging with each other are formed, and a concave portion 5 and a convex portion 6 are installed on the partition wall on anode side, and a groove-like concave portion and a convex portion are also provided on the partition wall on cathode side at such position as to engage with irregular surfaces on anode side.

On the convex portion of the partition wall on anode side, an anode is bonded directly or via a conductive spacer (not shown) as an electrode 7 by welding. The anode is made of expanded metal, porous plate, etc. covered with anode active covering, which comprises oxides of metal of platinum family. On the convex portion of the partition wall on cathode side, a cathode is attached by welding or other means. It is made of expanded metal, porous plate etc. covered with cathode active covering, which comprises metal of platinum family, and it is bonded directly or via a conductive spacer.

The irregular surfaces are divided into four sectors, i.e. a first sector 11, a second sector 12, a third sector 13, and a fourth sector 14 from the above in this order. Concave portion and convex portion in each sector are formed as a trough 15 and a ridge 16 respectively extending in vertical direction of the electrolyzer unit. Adjacent troughs are connected with each other, and a liquid junction 17 connecting the adjacent troughs with each other and also connecting the troughs in upper and lower sectors with each other is provided in each sector. The sectors arranged in vertical direction on the electrolyzer unit are not limited to four sectors, i.e. the first sector to the fourth sector, but there may be 3 sectors or 5 or more sectors.

Electrolytic solution is introduced through an electrolytic solution in let 18 through an electrolytic solution supply pipe 19 installed inside the electrolyzer frame 3 into internal space of the electrode chamber 4 from an electrolytic solution blow port 20 arranged on lower portio n of the electrode chamber. The electrolytic solution goes up along the troughs of the electrode chamber together with gas generated in the electrolyzer, and it further goes up from the liquid junction toward left or right troughs while changing the flow passage. While it is going up, mixing of the electrolytic solution proceeds, and concentration of the electrolytic solution becomes even.

Further, in the electrolyzer of the present invention, an internal circulation member 21 is provided between the partition wall 2 and the electrode 7. In the sector between the partition wall 2 and the internal circulation member 21, the electrolytic solution containing bubble s generated at the electrode does not flow in. With the bubbles separated in t he upper portion of the electrode chamber, the electrolytic solution flows downward, and it is circulated in the electrode chamber.

Even when the partition walls 2 are not designed in the same shape from below to the above as in the electrolyzer of the present invention, an internal circulation passage for electrolytic solution can be formed from above toward below by designing the internal circulation member 21 in such form as to match the irregular surfaces of the partition wall.

The electrolyzer of the present invention comprises ridges, troughs and liquid junctions to promote even distribution of concentration of the electrolytic solution on the partition wall 2, and the internal circulation member for the electrolytic solution is provided. In this respect, as shown in FIG. 1, even in case of a large size electrolyzer with longer depth from the inlet of electrolytic solution, the electrolytic solution can be circulated to full extent inside the electrode chamber, and electrolysis can be achieved in efficient manner.

Figure 2:
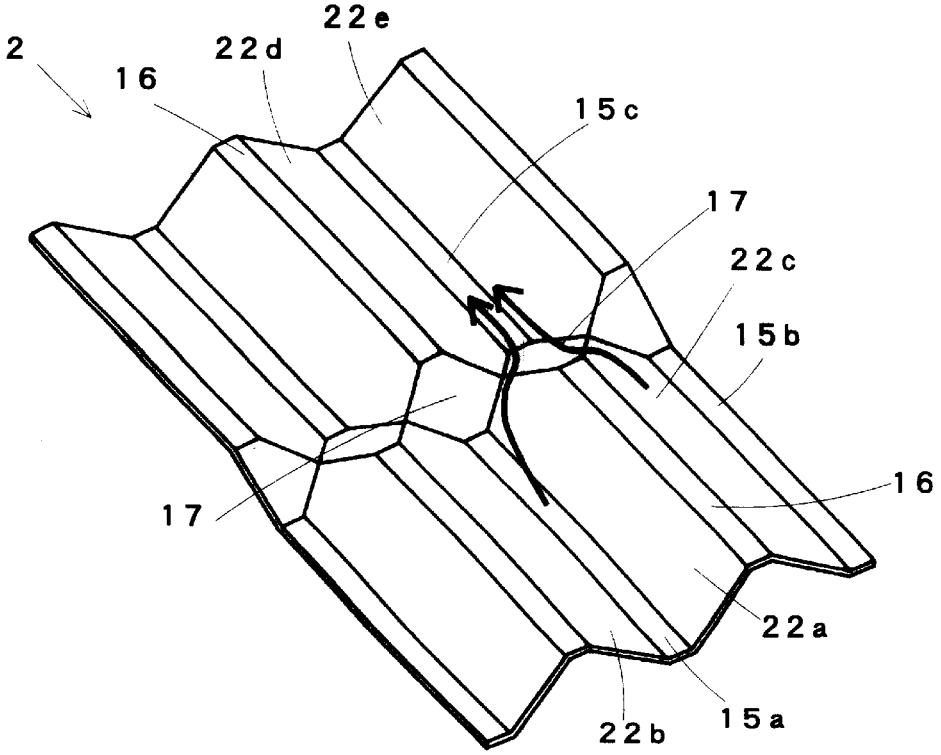
FIG. 2 is a drawing to explain partition walls with irregular surfaces as used in a unit electrolyzer of the electrolyzer of the present invention.

FIG. 2 is a drawing to explain a partition wall having irregular surfaces as used in a unit electrolyzer of the electrolyzer of the present invention.

The electrolytic solution flows from a trough 15*a* formed by inclined surfaces 22*a* and 22*b* and from a trough 15*b* formed by an inclined surface 22*c* into a liquid junction 17, and these streams of solution join together at the liquid junction 17, and then, this flows to a trough 15*c*, which is formed by an inclined surfaces 22*d* and 22*e* of the next sector. As a result, the streams of the electrolytic solution coming from the adjacent troughs join together at the liquid junction, and the solutions are mixed together and concentration is evenly distributed.

Figure 3:
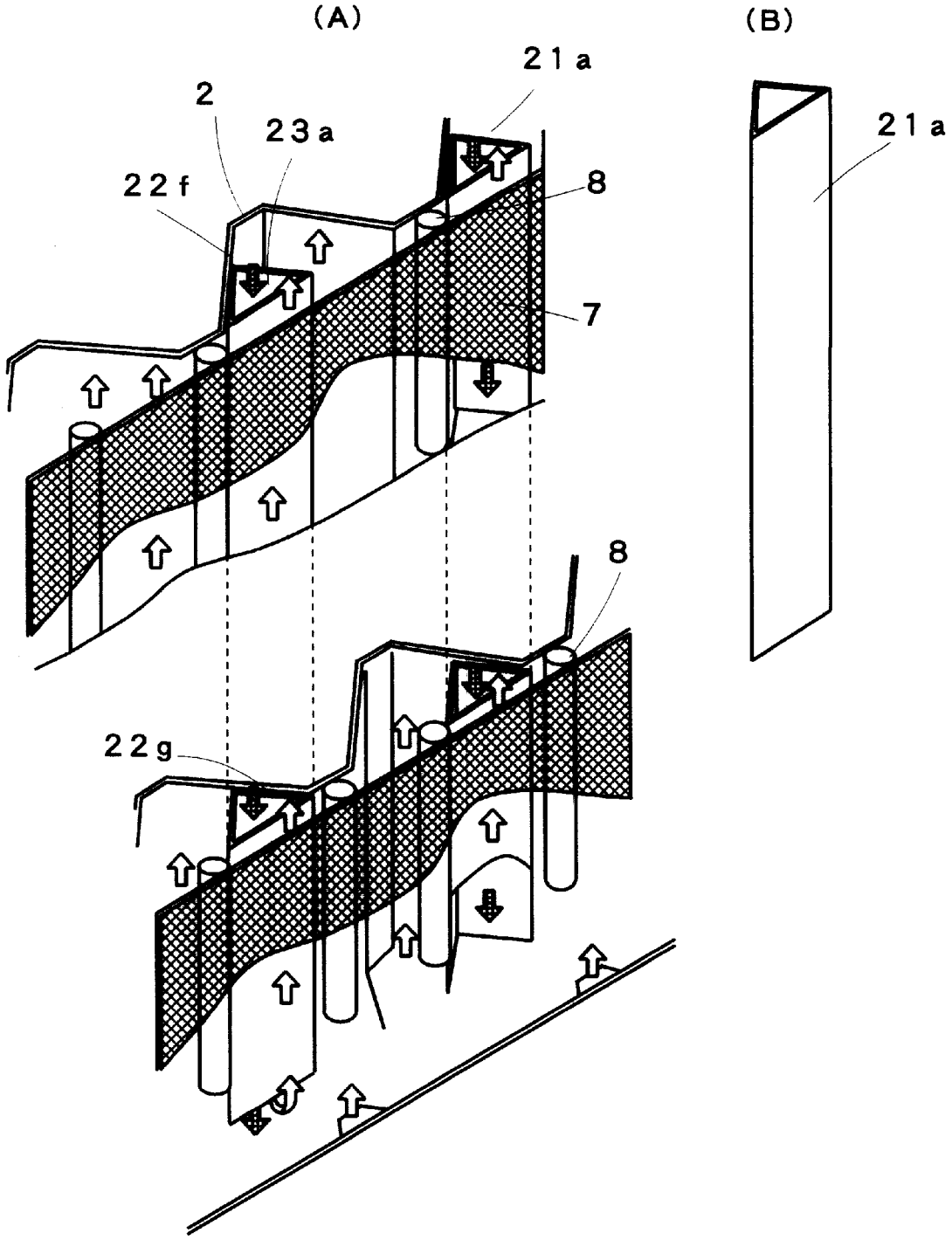
FIGS. 3A and B represent perspective views to explain an embodiment of an internal circulation member in the electrolyzer of the present invention.

FIG. 3 shows perspective views to explain an embodiment of an internal circulation member in the electrolyzer of the present invention.

FIG. 3 (A) is a partially cutaway views of electrodes and partition walls in different sectors above and below. FIG. 3 (B) shows an internal circulation member in form of a triangle pole.

The partition wall 2 is designed in such manner that troughs and ridges are deviated by a half pitch from one sector to another. The triangle pole type internal circulation member 21*a* with its two surfaces touches alternately the inclined surfaces 22*f* and 22*g* (inclined in different directions) of the partition wall. As a result, even in case the troughs are not aligned along a straight line as in the electrolyzer of the present invention, the triangle pole type internal circulation member can be mounted. Outside the internal circulation member, ascending flow is generated by the flow of the electrolytic solution coming from the lower portion of the electrolyzer and also by bubbles generated from electrolysis. Then, descending flow of the electrolytic solution is generated in an internal electrolytic solution circulation passage 23*a* of the internal circulation member, and the electrolytic solution is circulated.

In the electrolyzer of the present invention, the electrode 7 may be directly attached to the ridges of the partition wall 2, while it may be designed in such manner that a conductive spacer 8 made of a metal bar is attached to the ridge and the electrode is bonded to the conductive spacer by welding. In so doing, the bonded portion of the electrode is also present at a position on the partition wall, i.e. on a plane of projection from the troughs, and this makes it possible to provide the better electric current distribution to the electrode and the better condition to maintain electrode shape. Further, the conductive spacer forms a gap between the electrode and the internal circulation member, and this is helpful to create the better condition to form the circulation passage of the electrolytic solution.

Figure 4:
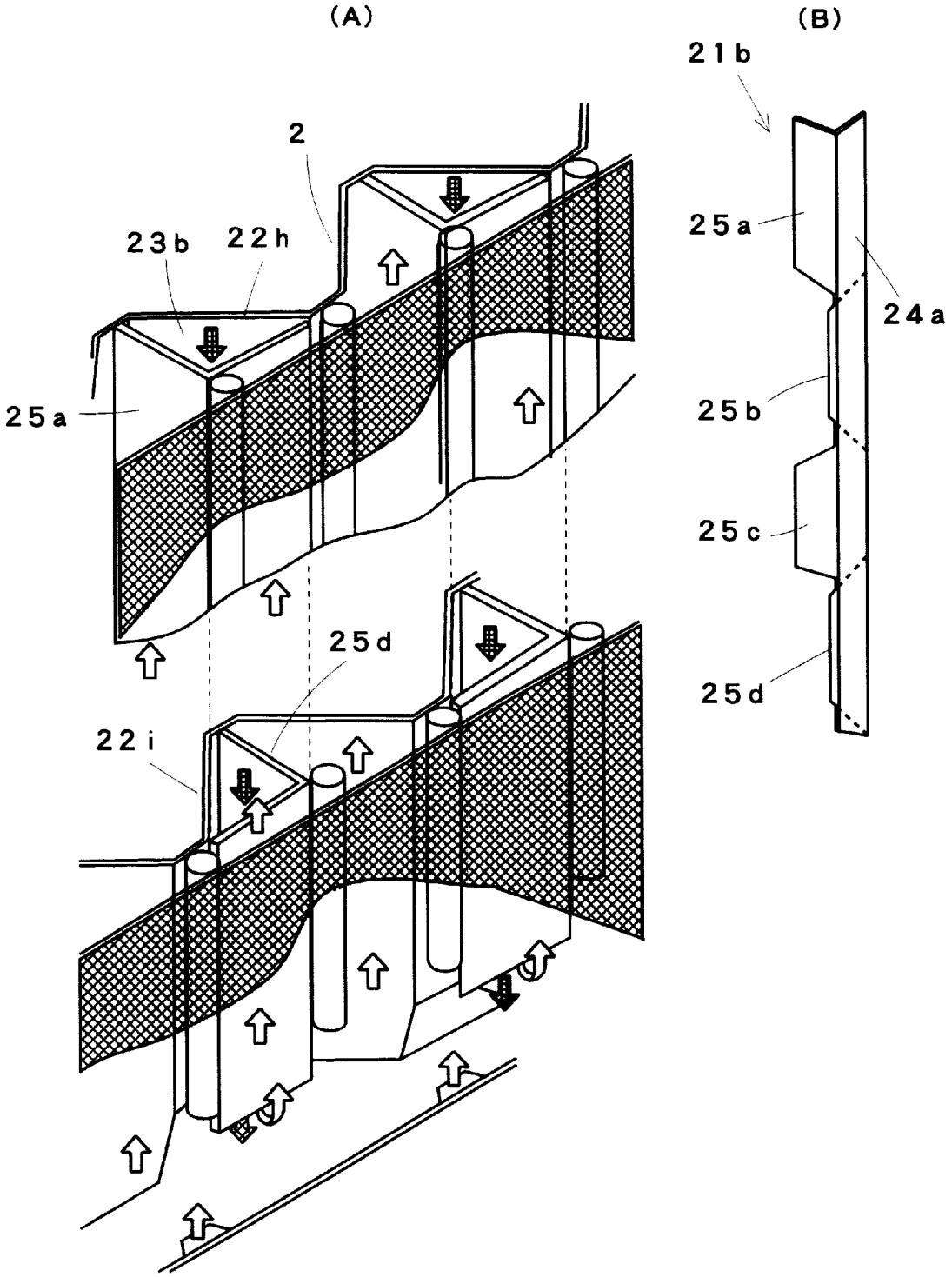
FIGS. 4A and B show perspective views to explain another embodiment of the internal circulation member in the electrolyzer of the present invention.

FIG. 4 is a perspective view to explain an embodiment of the internal circulation member to be arranged on the electrolyzer of the present invention.

FIG. 4 (A) is a partially cutaway view of the electrode and the partition wall, showing the partition walls in upper and lower sectors and an internal circulation member 21*b*. In the upper sector, a lateral end in longitudinal portion of the internal circulation member 21*b* is brought into contact with a ridge 16. On the lateral end not in contact with the ridge, a lateral portion is formed, and an internal electrolytic solution circulation passage 23*b* is formed by an inclined surface 22*h* of the trough of the partition wall 2 and the lateral portion 25*a*. This indicates that a ridge is formed on an extension of the trough of the upper sector. In the lower sector, an internal electrolytic solution circulation passage 23*b* is formed by an inclined surface 22*i* of the partition wall and a lateral portion 25*d* of the internal circulation member 22*b*.

FIG. 4 (B) is a perspective view to explain the internal circulation member 21*b*. From a lateral end opposite to the lateral end, which is in contact with the ridge of the partition wall of the longitudinal portion when the partition wall is installed in the electrode chamber unit, lateral portions 25*a*, 25*b*, 25*c* and 25*d* are extended from a longitudinal portion 24*a* alternately in a first direction and in another direction perpendicular to the first direction, and an internal circulation passage is formed by the longitudinal portion 24, the lateral portion and the inclined surface of the partition wall.

Figure 5:
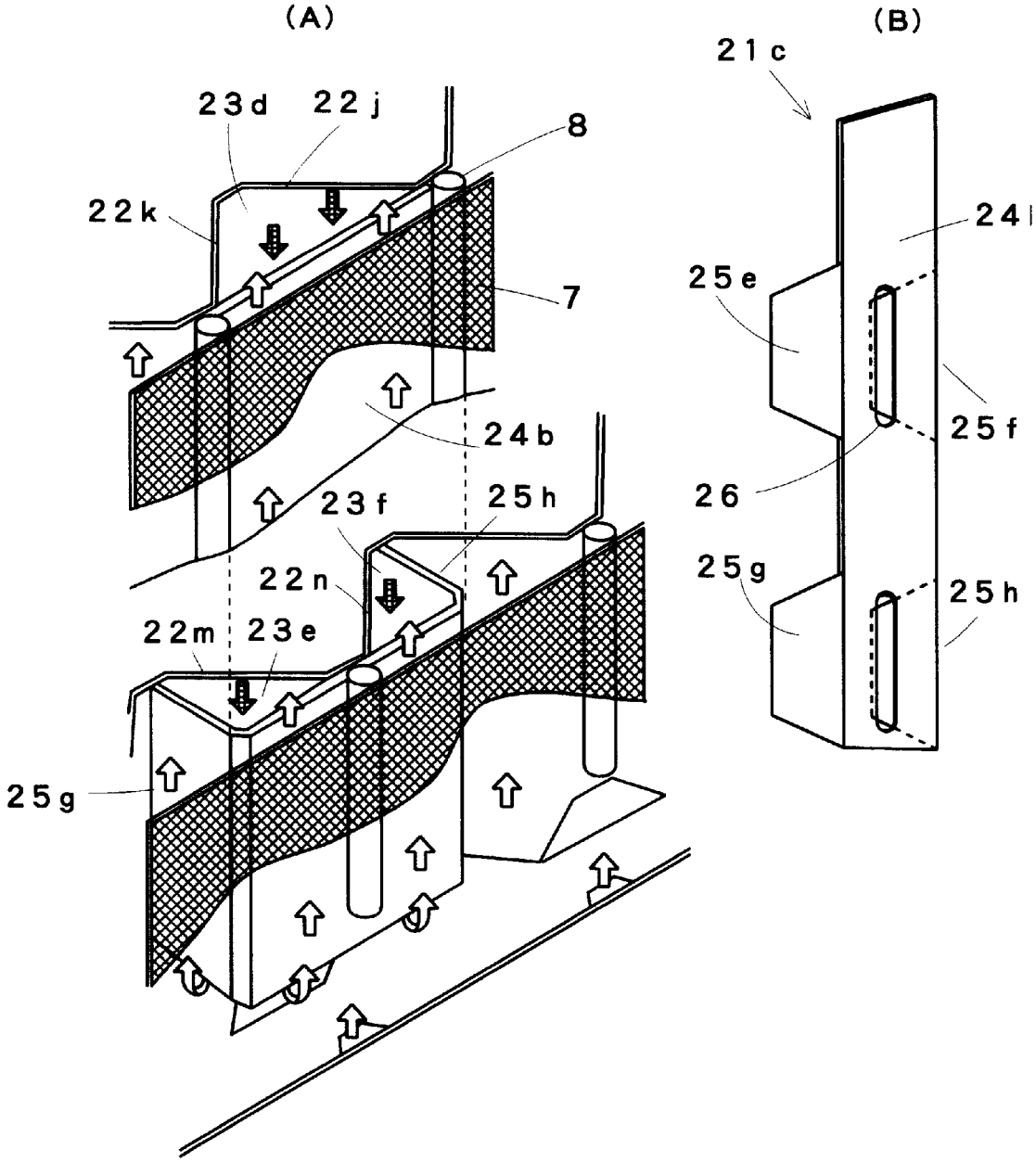
FIGS. 5A and B show perspective views to explain another embodiment of the internal circulation member in the electrolyzer of the present invention.
Figure 6:
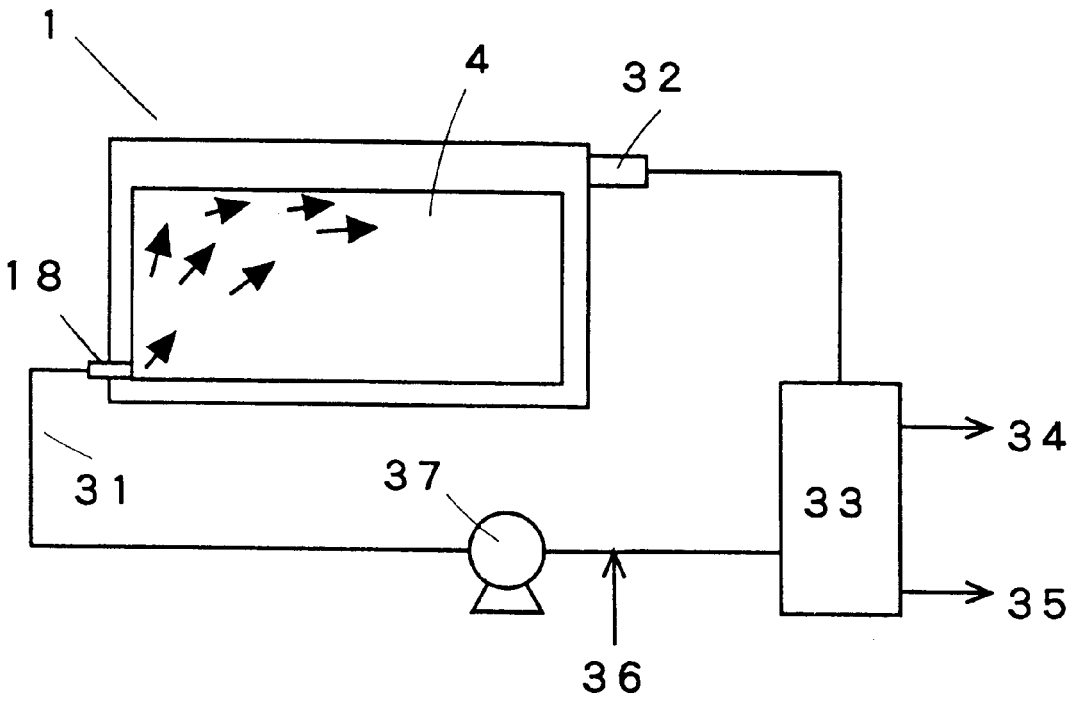
FIG. 6 is a schematical drawing to explain a method to circulate electrolytic solution by external circulation of the electrolytic solution.
Figure 7:
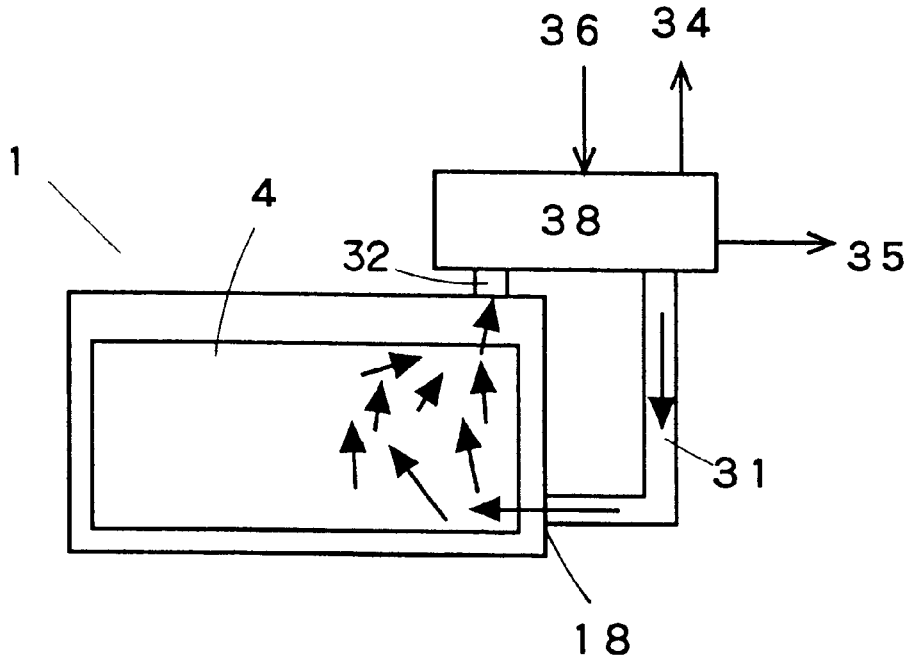
FIG. 7 is a schematical drawing to explain a circulation method utilizing difference of specific gravity of the electrolytic solution caused by electrolysis.

FIG. 5 is a perspective view to explain another embodiment of the internal circulation member to be installed in the electrolyzer of the present invention.

FIG. 5 (A) is a partially cutaway view of the electrode and the partition wall, showing inclined surfaces of the partition wall and the internal circulation member. An internal circulation passage 23*d* is formed by inclined surfaces 22*j* and 22*k* of a trough of the partition wall 2 and by a planar portion 24*b* of an internal circulation member 21*d*.

On an extension of the trough formed by the inclined surfaces 22*j* and 22*k*, a ridge is positioned, which is formed by inclined surfaces 22*m* and 22*n* as shown in the figure. An internal electrolytic solution circulation passage 23*e* is formed by the inclined surface 22*m* and a lateral portion 25*g* of the internal circulation member 21*d*. Also, an internal electrolytic solution circulation passage 23*f* is formed by the inclined surface 22*n* and a lateral portion 25*h* of the internal circulation member 21*d*. The internal electrolytic solution circulation passages 23*e* and 23*f* are communicated with the internal electrolytic solution circulation passage 23*d* formed in the upper sector, and this provides a circulation passage where descending flow of the electrolytic solution goes down.

FIG. 5 (B) is a perspective view to explain the internal circulation member 21*d*. On the internal circulation member 21*d*, lateral portions 25*e*, 25*f*, 25*g* and 25*h* are extended alternately in different directions, i.e. in a first direction and in a different direction perpendicular to the first direction, from the longitudinal portion 24*b*, which faces to the electrode surface when installed in the electrode chamber unit. An internal circulation passage is formed by the partition wall and the longitudinal portion 24*b*, and the lateral portions 25*e*, 25*f*, 25*g* and 25*h* of the internal circulation member 21*b*. Also, by providing a connecting hole 26 to connect a conductive spacer to the ridge, conductive connection resistance between the conductive spacer and the partition wall can be reduced.

In the electrolyzer of the present invention, the internal circulation member is not designed with the purpose of maintaining the strength of the electrolyzer within the electrolyzer or of supplying electric current, and it can be manufactured using materials formed by thin metal plate of the same type as the material used in the partition wall by welding or other means. For example, on the anode chamber side, titanium thin plate of 0.5 to 0.3 mm in thickness may be used. On the cathode chamber side, nickel thin plate of 0.5 to 0.3 mm in thickness may be used.

To mount the internal circulation member, it is mounted by welding or other means on the partition wall before mounting the electrode. The triangle pole type internal circulation member as shown in FIG. 3 can be mounted in a space after the electrode has been mounted.

The material to form the internal circulation member is not limited to the material of planar shape and it may be a member with curved surface as far as it can form a space between irregular inclined surface of the partition wall in the electrode chamber and itself.

The number of the internal circulation members to be mounted and the mounting position can be determined arbitrarily depending upon the size of the electrolyzer. Regarding the structure of the internal circulation member, one type or several types of the members as shown in FIG. 3 to FIG. 5 may be mounted.

According to the electrolyzer of the present invention, electrolytic solution can be supplied evenly from the lower portion of the electrode chamber frame. By the irregular surfaces on the partition wall, it is possible to circulate the electrolytic solution in more satisfactory manner. Because the internal circulation member is designed to suit the irregular surfaces, the electrolytic solution can be circulated within the electrode chamber in more satisfactory manner, and this leads to even distribution of concentration and temperature of the electrolytic solution.

Because the circulation of the electrolytic solution in the electrode chamber can be improved, uneven distribution of concentration and temperature of the electrolytic solution in the electrode chamber can be avoided, and this makes it possible to provide higher efficiency in voltage and current and to guarantee longer service life of the ion exchange membrane.

What is claimed is:

1. An electrolyzer, comprising vertical electrolyzer units with irregular surfaces formed on partition walls on anode side and on partition walls on cathode side, said irregular surfaces being overlapped on each other and integrated, and electrode plates being connected to convex portions of the partition walls, whereby said irregular surfaces are formed as troughs and ridges extending in vertical direction of the electrolyzer units, said irregular surfaces are divided into a plurality of sectors in height direction, said trough in each sector extends along the same straight line as the ridge of another sector, a liquid junction is provided to connect adjacent troughs in the same sector in the connecting portion of the adjacent sector and to connect the troughs in adjacent sectors, and an internal circulation member is provided between the partition wall and the electrode surface, using inclined surfaces of the trough on the partition wall or a member parallel to the inclined surface of the trough of the partition wall as dividing walls, thereby forming an internal circulation passage where the electrolytic solution flows down, the internal circulation passage being formed by an inclined surface of a trough in each sector and by an internal circulation member, one lateral end of the internal circulation member extending in longitudinal direction of the electrode chamber being in contact with a ridge on the partition wall, and a lateral portion in contact with the partition wall, extending in the direction of the partition wall, and defining the trough and the liquid junction being provided on a lateral end of the longitudinal member opposite to the portion in contact with the ridge of the partition wall.

2. An electrolyzer, comprising vertical electrolyzer units with irregular surfaces formed on partition walls on anode side and on partition walls on cathode side, said irregular surfaces being overlapped on each other and integrated, and electrode plates being connected to convex portions of the partition walls, whereby said irregular surfaces are formed as troughs and ridges extending in vertical direction of the electrolyzer units, said irregular surfaces are divided into a plurality of sectors in height direction, said trough in each sector extends along the same straight line as the ridge of another sector, a liquid junction is provided to connect adjacent troughs in the same sector in the connecting portion of the adjacent sector and to connect the troughs in adjacent sectors, and an internal circulation member is provided between the partition wall and the electrode surface, using inclined surfaces of the trough on the partition wall or a member parallel to the inclined surface of the trough of the partition wall as dividing walls, thereby forming an internal circulation passage where the electrolytic solution flows down, the internal circulation passage being formed by an inclined surface of a trough in each sector and by an internal circulation member, said internal circulation member comprising a longitudinal member extending in longitudinal direction of the electrode chamber, and a lateral member extending from a lateral end of the longitudinal member and defining the trough and the liquid junction, and in a sector adjacent to a sector where the entire surface of the trough is covered with the longitudinal member, the central portion of the longitudinal member being positioned on a ridge of the partition wall in a second sector adjacent to a first sector, and there are provided two lateral portions extending from the lateral end of the longitudinal member toward the partition wall and in contact with the partition wall.

* * * * *